US008747252B2

(12) United States Patent
Lukasiewicz, Jr. et al.

(10) Patent No.: US 8,747,252 B2
(45) **Date of Patent: *Jun. 10, 2014**

(54) EXTREME WEIGHTED HYBRID AND OTHER WOOD-TYPE GOLF CLUBS AND GOLF CLUB HEADS

(71) Applicant: NIKE, Inc., Beaverton, OR (US)

(72) Inventors: Robert Lukasiewicz, Jr., Portland, OR (US); Robert Boyd, Flower Mound, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/722,528

(22) Filed: Dec. 20, 2012

(65) Prior Publication Data

US 2013/0109499 A1 May 2, 2013

Related U.S. Application Data

(63) Continuation of application No. 13/442,207, filed on Apr. 9, 2012, now Pat. No. 8,337,326, which is a continuation of application No. 12/841,478, filed on Jul. 22, 2010, now Pat. No. 8,167,739, which is a continuation of application No. 12/031,322, filed on Feb. 14, 2008, now Pat. No. 7,785,212.

(51) Int. Cl.
*A63B 53/04* (2006.01)
*A63B 53/06* (2006.01)

(52) U.S. Cl.
USPC ..... 473/332; 473/334; 473/345; 473/346; 473/349

(58) Field of Classification Search
USPC ..... 473/324–350, 287–292, 256
See application file for complete search history.

(56) References Cited

U.S. PATENT DOCUMENTS 1,096,359 A 5/1914 Dwight
1,319,233 A 10/1919 Mattern (Continued)

FOREIGN PATENT DOCUMENTS

CN 2379166 5/2000
FR 2672226 8/1992

(Continued)

OTHER PUBLICATIONS

International Search Report and Written Opinion in related International PCT Application No. PCT/US2009/033645; mailed Jul. 1, 2009.

(Continued)

*Primary Examiner* — Sebastiano Passaniti
(74) *Attorney, Agent, or Firm* — Banner & Witcoff, Ltd.

(57) ABSTRACT

Wood-type golf club heads include: (a) a club head body member defining an interior chamber; (b) a weight system engaged with a rear perimeter portion of the club head body member; and (c) a connection system connecting the weight system with the club head body (e.g., with the rear of the ball striking face portion). The club heads further may include one or more damping members in the interior chamber to alter the sound and/or otherwise attenuate a vibrational response of the club head. The damping members may extend between the ball striking face and the weight system, and optionally may engage the connection system. The damping member(s) may constitute a foam material compressed within the interior chamber of the club head. Methods of making such golf club head structures also are described.

15 Claims, 11 Drawing Sheets

(56) References Cited

U.S. PATENT DOCUMENTS

| | | | | |
|---|---|---|---|---|
| 1,444,409 | A | 2/1923 | Willmott | |
| 1,534,600 | A | 4/1925 | Mattern | |
| 1,567,248 | A | 12/1925 | Dahlman | |
| 1,946,208 | A | 2/1934 | Hampton | |
| 2,702,060 | A | 2/1955 | Bonnesen | |
| 3,516,674 | A | 6/1970 | Scarborough | |
| 3,567,228 | A | 3/1971 | Lynn | |
| 4,076,254 | A | 2/1978 | Nygren | |
| 4,535,990 | A | 8/1985 | Yamada | |
| 4,732,389 | A | 3/1988 | Kobayashi | |
| 4,811,950 | A | 3/1989 | Kobayashi | |
| 5,176,383 | A | 1/1993 | Duclos | |
| 5,193,811 | A | 3/1993 | Okumoto et al. | |
| 5,380,010 | A | 1/1995 | Werner et al. | |
| 5,421,577 | A | 6/1995 | Kobayashi | |
| 5,464,211 | A | 11/1995 | Atkins, Sr. | |
| 5,516,107 | A | 5/1996 | Okumoto et al. | |
| 5,547,427 | A | 8/1996 | Rigal et al. | |
| 5,586,948 | A | 12/1996 | Mick | |
| 5,890,973 | A | 4/1999 | Gamble | |
| 6,099,414 | A | 8/2000 | Kusano et al. | |
| 6,159,109 | A | 12/2000 | Langslet | |
| 6,206,789 | B1 | 3/2001 | Takeda | |
| 6,217,461 | B1 | 4/2001 | Galy | |
| 6,332,848 | B1 | 12/2001 | Long et al. | |
| 6,332,849 | B1 | 12/2001 | Beasley | |
| 6,354,961 | B1 | 3/2002 | Allen | |
| 6,558,271 | B1 | 5/2003 | Beach et al. | |
| 6,835,144 | B2 | 12/2004 | Best | |
| 6,890,267 | B2 | 5/2005 | Mahaffey et al. | |
| 6,929,563 | B2 | 8/2005 | Nishitani | |
| 6,991,560 | B2 | 1/2006 | Tseng | |
| 7,048,646 | B2 | 5/2006 | Yamanaka et al. | |
| 7,121,956 | B2 | 10/2006 | Lo | |
| 7,632,193 | B2 * | 12/2009 | Thielen | 473/334 |
| 7,785,212 | B2 * | 8/2010 | Lukasiewicz et al. | 473/332 |
| 7,988,568 | B2 * | 8/2011 | Stites et al. | 473/334 |
| 8,043,167 | B2 * | 10/2011 | Boyd et al. | 473/334 |
| 8,167,739 | B2 * | 5/2012 | Lukasiewicz et al. | 473/332 |
| 8,337,326 | B2 * | 12/2012 | Lukasiewicz et al. | 473/332 |
| 2002/0098910 | A1 | 7/2002 | Gilbert | |
| 2003/0232659 | A1 | 12/2003 | Mahaffey et al. | |
| 2004/0023730 | A1 | 2/2004 | Nagai et al. | |
| 2004/0053704 | A1 | 3/2004 | Gilbert | |
| 2005/0049074 | A1 | 3/2005 | Chen et al. | |
| 2005/0096151 | A1 | 5/2005 | Hou et al. | |
| 2005/0277485 | A1 | 12/2005 | Hou et al. | |
| 2006/0194641 | A1 | 8/2006 | Best | |
| 2007/0142123 | A1 * | 6/2007 | Franklin | 473/340 |
| 2007/0149310 | A1 | 6/2007 | Bennett et al. | |

FOREIGN PATENT DOCUMENTS

| | | |
|---|---|---|
| JP | 59164666 | 11/1984 |
| JP | 4347179 | 12/1992 |
| JP | 05103847 | 4/1993 |
| JP | 5103847 | 4/1993 |
| JP | 8322970 | 12/1996 |
| JP | 2007267777 | 10/2007 |

OTHER PUBLICATIONS

International Preliminary Report in related International PCT Application No. PCT/US2009/033645; issued Aug. 17, 2010.

Chinese Office Action in related Chinese Application No. 200980108939.7; issued Nov. 3, 2011.

Chinese Office Action in related Chinese Application No. 200980108939.7; issued Jul. 30, 2012.

Japanese Office Action from Japanese Patent Application No. 2010-546861; issued Dec. 3, 2012.

European Search Report from European Patent Application No. 10184691.3; dated Jan. 14, 2013.

European Office Action from European Patent Application No. 09709778.6; dated Jan. 24, 2013.

* cited by examiner

EXTREME WEIGHTED HYBRID AND OTHER WOOD-TYPE GOLF CLUBS AND GOLF CLUB HEADS

RELATED APPLICATION DATA

This application is a continuation of co-pending U.S. patent application Ser. No. 13/442,207 filed on Apr. 9, 2012 which is a continuation of U.S. patent application Ser. No. 12/841,478 filed on Jul. 22, 2010 which issued as U.S. Pat. No. 8,167,739 on May 1, 2012 which is a continuation of U.S. patent Application Ser. No. 12/031,322 filed on Feb. 14, 2008 which issued as U.S. Pat. No. 7,785,212 on Aug. 31, 2010. These applications are entirely incorporated herein by reference.

FIELD OF THE INVENTION

This invention relates generally to golf clubs and golf club heads, including "wood-type" golf clubs and golf club heads, e.g., for drivers, fairway woods, "wood-type" hybrid or utility clubs, or the like. Additional aspects of this invention relate to methods for making such golf club heads that include extreme rearward and/or low weighting characteristics.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Despite recent technological advances, "wood-type" golf clubs, particularly the driver and long irons (e.g., 1-4 irons), can be very difficult for some players to hit consistently well. Accordingly, additional technological advances that improve a player's ability to get a golf ball airborne; increase distance, direction, and/or control; and/or otherwise improve the playability of wood-type golf clubs, particularly the driver, would be welcome in the golf world.

SUMMARY

The following presents a general summary of aspects of the invention in order to provide a basic understanding of the invention and various aspects of it. This summary is not overview and context for the more detailed description that follows.

In general, some example aspects of this invention relate to wood-type golf clubs and/or golf club heads (such as drivers, fairway woods, "wood-type" utility or hybrid clubs, and the like). Golf club heads and golf clubs in accordance with at least some examples of this invention include club head structures having: (a) a club head body member defining an interior chamber, the club head body member including a ball striking face portion, a crown portion, and a sole portion; (b) a weight system engaged with the club head body member and provided at a perimeter portion of the club head body member at a location rearward of the ball striking face portion; and (c) a connection system extending from or through the weight system in a direction toward and at least partially through the interior chamber and toward the ball striking face portion of the club head body member. In some examples, the connection system will extend from or through the weight system and engage the weight system with a rear surface of the ball striking face portion of the club head body member.

At least some example club head structures in accordance with this invention will include one or more damping members at least partially located within the interior chamber defined by the club head body member. The damping member(s) (which may alter the sound and/or otherwise attenuate a vibrational response of the club head when a golf ball is struck) may extend between the ball striking face portion and the weight system. In at least some examples according to this invention, the damping member(s), may constitute a foam material that is compressed within the interior chamber of the club head body member (e.g., between the weighting system and the rear surface of the ball striking face portion). If desired, the weight system may directly engage the damping member, e.g., it may be at least partially embedded in the damping member, it may fit into a slot, groove, or chamber formed in the damping member, it may extend at least partially around a periphery of the damping member (e.g., along the sides and/or rear periphery, etc.), etc. The weight system also may be located inside or outside the interior chamber defined by the club head body.

Methods of making golf club head structures in accordance with at least some examples of this invention may include, for example: (a) providing a wood-type golf club head body member including a ball striking face portion, a crown portion, and a sole portion, wherein the club head body member, at least in part, defines an interior chamber; and (b) engaging a weight system with a perimeter portion of the club head body member at a location rearward of the ball striking face portion, wherein the weight system is engaged with the club head body member via a connection system that extends from or through the weight system in a direction toward and at least partially through the interior chamber and toward the ball striking face portion. If desired, in accordance with at least some example structures according to this invention, a damping member may be provided within the interior chamber defined by the club head body member.

Such club head structures may be incorporated into an overall golf club structure and/or used as a golf club in any desired manner, including in conventional manners that are known and used in the art.

BRIEF DESCRIPTION OF THE DRAWINGS

A more complete understanding of the present invention and certain advantages thereof may be acquired by referring to the following detailed description in consideration with the accompanying drawings, in which.

Figure 1A:
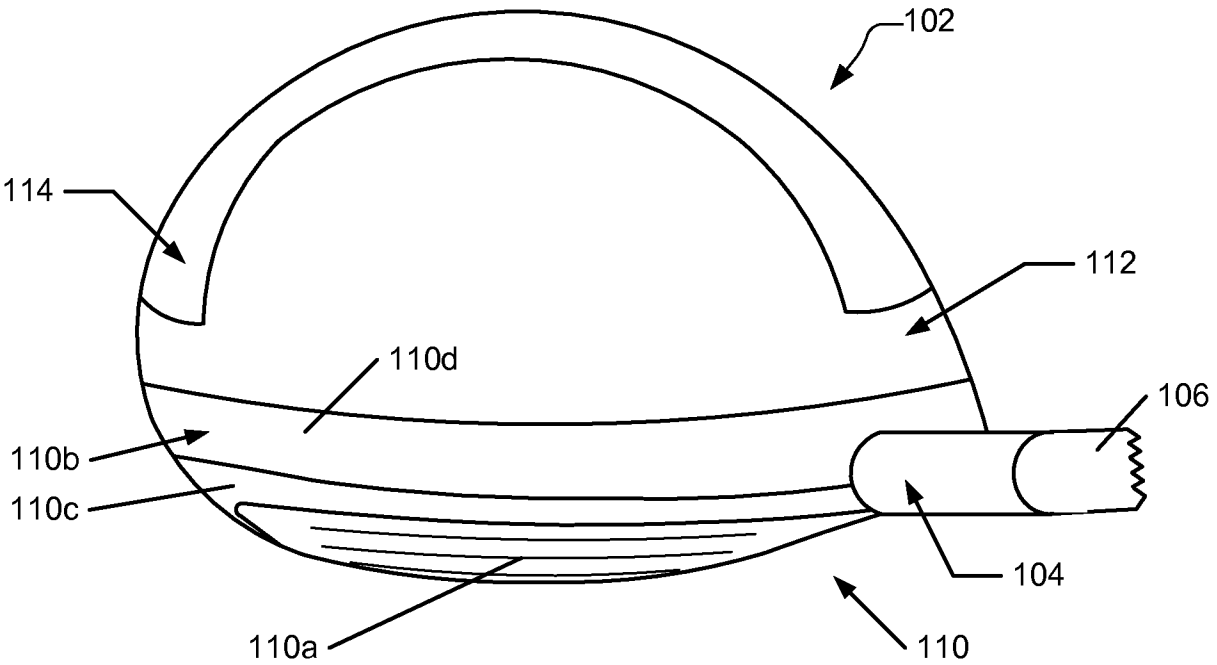
FIGS. 1A and 1B illustrate an example golf club head structure according to the invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example golf club heads and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Golf Club Heads and Golf Clubs According to Examples of the Invention In general, as described above, aspects of this invention relate to wood-type golf club heads, golf clubs, and the like (such as drivers or fairway woods, "wood-type" utility or hybrid clubs, and/or the like), as well as to methods of making and using such clubs and club heads. Wood-type golf club heads in accordance with at least some examples of this invention include: (a) a club head body member defining an interior chamber, the club head body member including a ball striking face portion, a crown portion, and a sole portion; (b) a weight system engaged with the club head body member and provided at a perimeter portion of the club head body member at a location rearward of the ball striking face portion; and (c) a connection system extending from or through the weight system in a direction toward and at least partially through the interior chamber and toward the ball striking face portion of the club head body member. The weight system may comprise one or more separate weight members that are engaged with the rear perimeter of the club head body member, optionally with the exterior of the club head body member. In some examples, the connection system will extend from or through the weight system and engage the weight system with a rear surface of the ball striking face portion of the club head body member.

At least some example club head structures in accordance with this invention will include one or more damping members at least partially located within the interior chamber defined by the club head body member. The damping member(s) (which may alter the sound and/or otherwise attenuate a vibrational response of the club head when a golf ball is struck) may extend at least partially between the ball striking face portion and the weight system. In at least some examples according to this invention, the damping member(s) may constitute a foam or other material that is compressed within the interior chamber of the club head body member (e.g., between the weighting system and the rear surface of the ball striking face portion). The damping member(s) also may be engaged with at least some portion of the connection system (e.g., one or more bolts or other mechanical fastener elements forming at least part of the securing system may extend through an opening provided in the damping member(s)).

The club head body member may take on a variety of different forms, shapes, and/or sizes without departing from this invention. For example, the club head may be made of a one piece construction or from a multi-piece construction. Multi-piece constructions also may take on a variety of different forms without departing from this invention, including, for example, multi-piece constructions that include one or more of the following: a ball striking face member (optionally with a ball striking plate integrally formed with a face element (such as a cup face member)); a crown member (e.g., made from a lightweight material, such as carbon fiber or other composite materials, basalt fiber reinforced materials, etc.); a sole member; a sole plate (e.g., made from a durable and/or a relatively dense material (as compared to the crown member), such as a metal material like titanium, steel, aluminum, or other metals or alloys); an aft body member (e.g., including at least some portions of a crown portion, a ribbon portion or other body portion, and/or a sole portion); a ribbon member; etc.

Golf club heads in accordance with examples of this invention may include still additional features, if desired, including features that are known and used in the art. For example, the weighting system may be permanently mounted to the club head body member, e.g., on an interior or exterior of the club head body, extending from the exterior to the interior of the club head body (e.g., through a weight port), etc. As yet additional examples, if desired, the weighting system may include weight member(s) that are movably and/or removably mounted with respect to the club head body member, e.g., using structures and techniques that are known and used in the art (e.g., by screw or other mechanical connector attachments, by sliding attachments, etc.). Advantageously, in accordance with at least some examples of this invention, the weighting system will include weight members located at or proximate to a rear of the club head body member, optionally with weighting features provided toward the rear toe, the rear heel, and/or the rear sole portions of the club head. If desired, at least some portions of the weighting system may be selectively movable and/or removable from the club head body member and/or mountable in a variety of different positions and/or arrangements, e.g., to allow customization, interchange, replacement, and/or club-fitting (e.g., to provide a draw biased club, to provide a fade biased club, to provide a high trajectory biased club, to provide a low trajectory biased club, to provide a club to help compensate for undesired ball flights or swing flaws (e.g., to help correct hooks, slices, etc., to help get balls airborne, to help prevent ballooning ball flights, etc.), to provide a club having a high moment of inertia (e.g., high Izz), etc.).

The club head body member may be made from a wide variety of materials and parts without departing from this invention, including in conventional ways, from conventional materials and parts, as are known and used in the art. In some more specific examples, the club head base member may be made from one or more of: metal materials (e.g., metal alloys, such as alloys containing steel, titanium, magnesium, aluminum, beryllium, etc.); composite materials (e.g., carbon fiber composites, basalt fiber composites, etc., for a crown portion, a skirt portion, a sole portion, an aft body portion, a ball striking face portion, etc.); polymeric materials; etc.

Additional aspects of this invention relate to golf club structures that include golf club heads, e.g., of the types described above (such as wood-type golf clubs including drivers, fairway woods, wood-type hybrid or utility clubs, etc.). In addition to club head structures of the types described above, golf clubs according to at least some examples of this invention may include one or more of: (a) a shaft member engaged with the club head body (e.g., with the ball striking face member, the club head body member, or both); (b) a grip member engaged with the shaft, and/or (c) a handle member engaged with the club head and/or the shaft. These additional elements of the golf club structure may be included in the overall club structure in any desired manner without departing from this invention, including in conventional manners that are known and used in the art (e.g., the shaft may be engaged via an external hosel member, via an internal hosel member, through an opening provided in the club head, via adhesives, via mechanical connectors (e.g., threads, retaining elements, etc.), etc.). Additionally, these additional elements of the golf club structure may be made from conventional materials, in conventional constructions, e.g., as are known and used in the art. If desired, any desired part(s) of the club head body may be formed to include a hosel element, or if desired, a hosel element of some type may be engaged with one or more of the ball striking face member and/or the body member (e.g., interior, exterior, or both, with respect to the overall club head structure).

B. General Description of Example Methods of Making and/or Using Golf Club Heads and Golf Clubs According to the Invention Additional aspects of this invention relate to methods of making golf club heads and/or golf club structures in accordance with this invention (e.g., of the various types described above). Such methods may include, for example: (a) providing a wood-type golf club head body member (e.g., by manufacturing it, by assembling it, by obtaining it from a third party source, etc.) including a ball striking face portion, a crown portion, and a sole portion, wherein the club head body member, at least in part, defines an interior chamber; and (b) engaging a weight system with a perimeter portion of the club head body member at a location rearward of the ball striking face portion, wherein the weight system is engaged with the club head body member via a connection system that extends from or through the weight system in a direction toward and at least partially through the interior chamber and toward the ball striking face portion. If desired, in accordance with at least some example structures according to this invention, a damping member may be provided within the interior chamber defined by the club head body member. In at least some examples of this invention, the connection system will extend from or through the weight system (and optionally through the damping member) and engage (e.g., fasten to) a rear side of the ball striking face portion.

The various parts of the club head structure may have any one and/or combination of the various more specific parts, structural features, and/or structural arrangements described above.

Golf clubs according to at least some examples of this invention may be produced by engaging a shaft member and/or handle member with the club head body (e.g., of the types described above). This may be accomplished in any desired manner, including in conventional manners that are well known and used in the art (e.g., via cements or adhesives, via mechanical connectors, etc.). Additionally, if desired, a grip element may be engaged with the shaft or handle member, e.g., in any desired manner, including in manners that are well known and used in the art (e.g., via cements or adhesives, via mechanical connectors, etc.). Golf club heads and golf clubs in accordance with this invention may be used in conventional ways as also are known in the art. Additionally, if desired, the shaft member may be connected to the head and/or to the grip member in releasable manners, as are known and used in the art.

Specific examples of the invention are described in more detail below. The reader should understand that these specific examples are set forth merely to illustrate examples of the invention, and they should not be construed as limiting the invention.

C. Specific Examples of the Invention

Figure 1B:
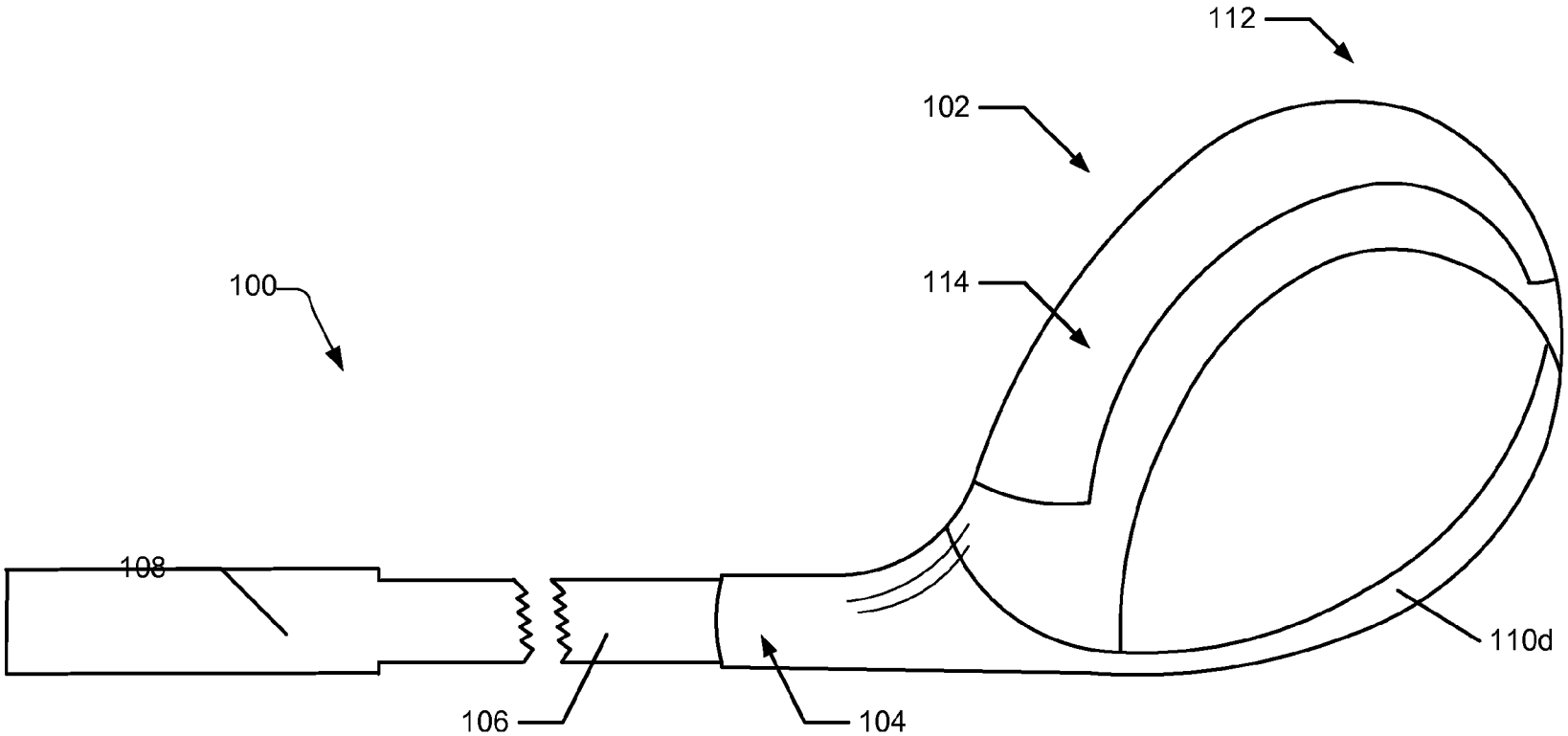

FIGS. 1A and 1B generally illustrate an example golf club 100 and golf club head 102 in accordance with this invention. Example golf club and golf club head structures in accordance with this invention may constitute "wood-type" golf clubs and golf club heads, e.g., club heads typically used for drivers and fairway woods, as well as for "wood-type" utility or hybrid clubs, or the like. Aspects of this invention, however, also may be used in producing putters, chipping clubs, and/or other golf club heads and/or golf club structures. More specific examples and features of golf club heads and golf club structures according to examples of this invention will be described in detail below in conjunction with the example golf club head structures illustrated in FIGS. 1A through 9.

FIGS. 1A and 1B generally illustrate a wood-type golf club 100 in accordance with one example of this invention. The golf club 100 includes a golf club head 102 having a multi-part construction (examples of which will be described in more detail below) and a hosel area 104 at which the head 102 is connected to a shaft 106. The hosel area 104 may be of any desired design and construction without departing from this invention (e.g., an exteriorly extending hosel member 104, as shown; an internal hosel member; etc.), including conventional designs and constructions as are known and used in the art. Likewise, the shaft 106 may be made of any desired materials and connected to the hosel area 104 (or directly to the club head 102) in any desired manner, including conventional materials, connected in conventional manners, as are known and used in the art. As some more specific examples, if desired, the shaft 106 may be made from steel, aluminum, or other metal or metal alloy materials; graphite based materials; composite materials; polymeric materials; etc. The shaft 106 may be connected to the hosel area 104 and/or directly to the club head 102 via cements or adhesives, via mechanical connection systems, and the like. If desired, the shaft 106 may be connected to the hosel area 104 or to the club head 102 by a releasable mechanical or adhesive connection that easily allows the club head 102 and shaft 106 to be separated from one another (and optionally thereafter engaged with a different head or shaft).

A grip member 108 or other handle element may be provided on and/or integrally formed with the shaft 106. Any desired materials may be used for the grip member 108, such as rubber based materials (synthetic or natural); polymer based materials (including cord or other fabric or textile containing polymers); leather; cork; etc. The grip member 108 or other handle element may be engaged with or formed as part of the shaft 106 in any desired manner without departing from this invention, including through the use of adhesives or cements, mechanical connectors (e.g., threaded connections, releasable mechanical connections, etc.), or the like. In at least some example structures according to this invention, the grip member 108 will be made of conventional materials as are known and used in the art, and it will be attached to the shaft member 106 in conventional manners as are known and used in the art.

The club head 102 may be made from any desired materials, numbers of parts, and/or constructions without departing from this invention. In this illustrated example, the club head 102 includes a ball striking face member 110 engaged with a club head body member 112. A weight system 114 is engaged with the club head body member 112. In this illustrated example, the weight system 114 comprises a single weight member that extends along a portion of the rear periphery of the club head body member 112. The weight system 114 may take on a variety of different forms, as will be described in more detail below in conjunction with other illustrated example structures according to this invention.

The ball striking face member 110 of this example structure is a multi-piece construction. While it may take on a variety of different forms, sizes, shapes, and/or materials, in this illustrated example, the ball striking face member 110 includes a ball striking face portion 110*a* engaged with a cup face element 110*b* (e.g., by welding or other fusing technique) that includes a face perimeter portion 110*c* and a return portion 110*d*. The ball striking face member 110 may be made from conventional materials as are known and used in the art, such as steel, titanium alloys, and the like. As shown in FIG. 1A, the ball striking face member 110 may form at least a portion of the hosel member 104 (if any), or the hosel member 104 may be made in other manners, including in conventional manners as are known and used in the art.

Figure 2A:
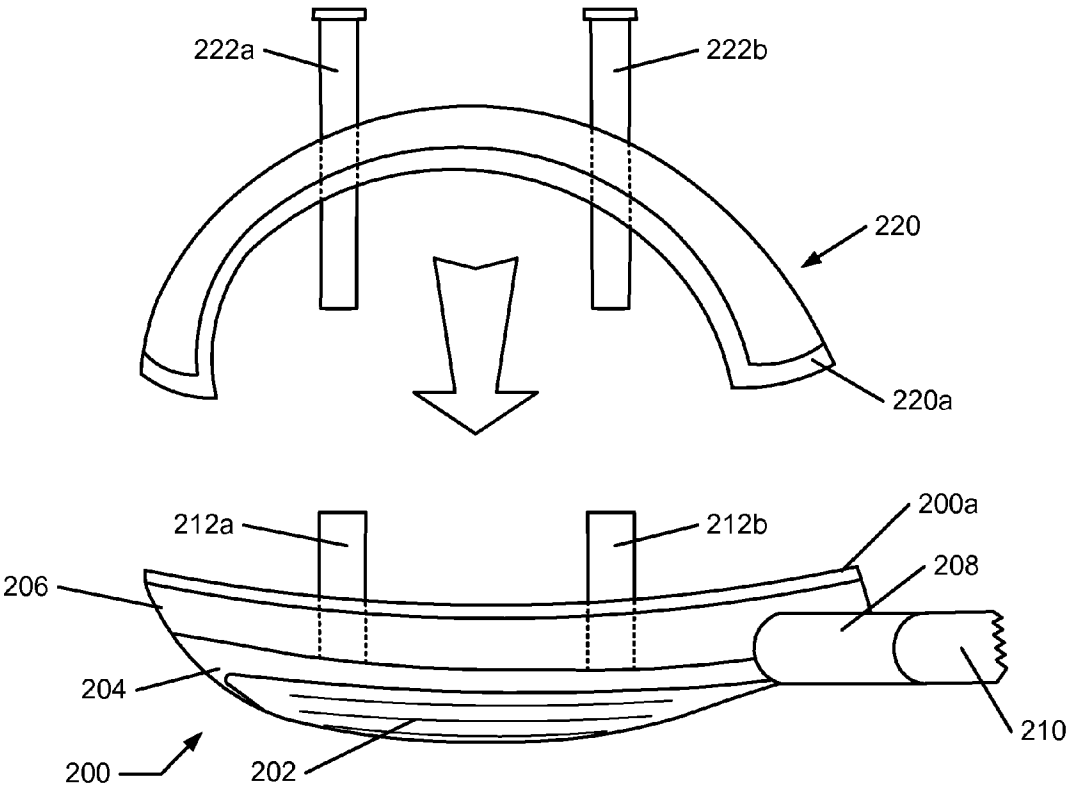
FIGS. 2A and 2B illustrate various steps and parts used in a method of making a golf club head in accordance with this invention.
Figure 2B:
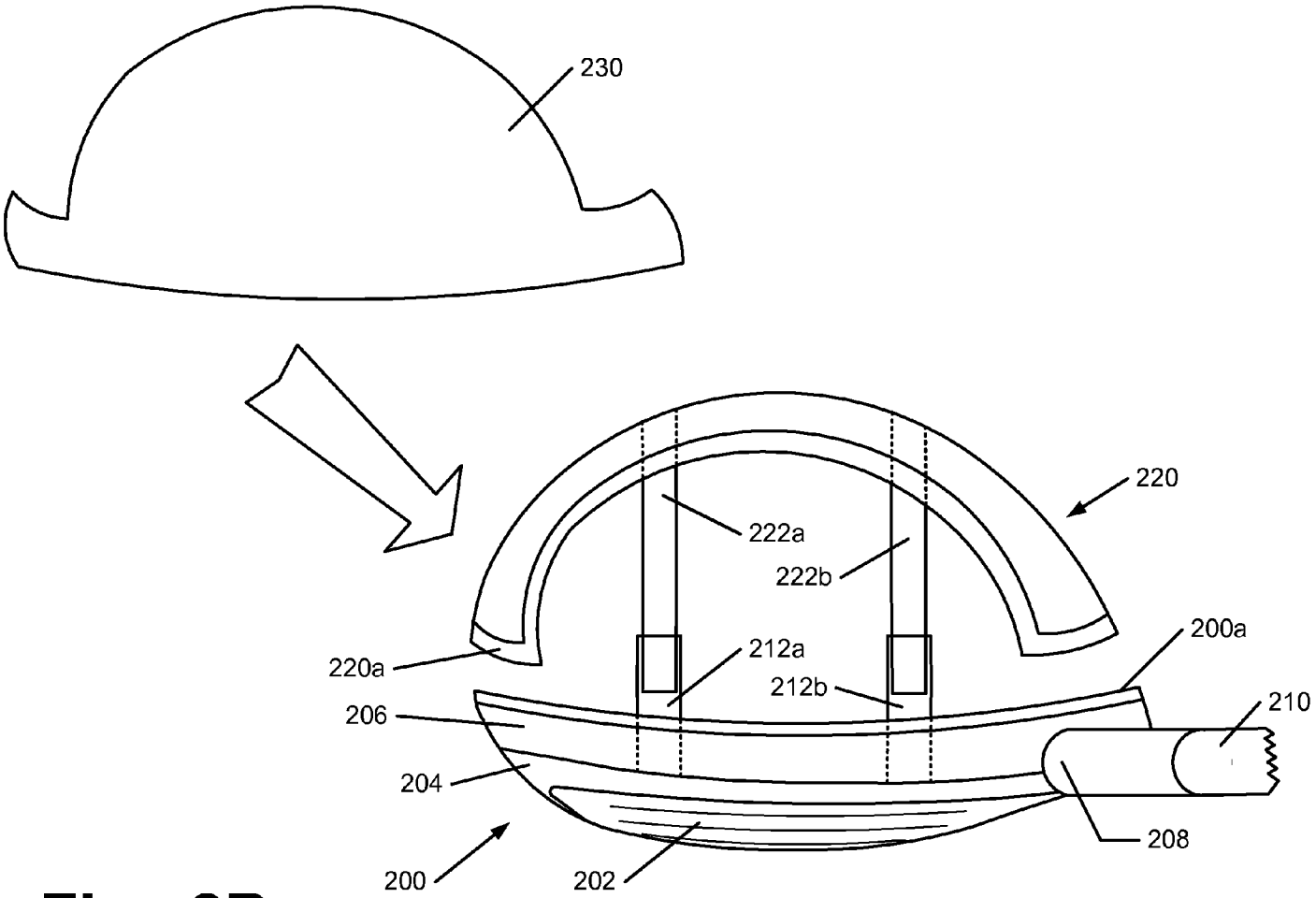

FIGS. 2A and 2B illustrate one example of a process for manufacturing or assembling a golf club head in accordance with this invention. As shown in FIG. 2A, this example procedure begins with a cup type club head face member 200 that includes a ball striking face portion 202, a face perimeter portion 204, and a return portion 206 that, in this example structure, extends rearward from the face perimeter portion 204 around the entire periphery of the face perimeter portion 204. Any desired face member structures or constructions may be used without departing from this invention. For example, the return portion 206 may be divided into individual or discrete segments; the return portion 206 may be provided around only a portion of perimeter portion 204; the return portion 206 may have different lengths in a direction rearward from the perimeter portion 204 (e.g., the return portion along the sole portion of the club head may be longer or shorter than the return portion along the crown portion of the club head, etc.); the return portion 204 may be omitted (and the club head body portions (as will be described in more detail below) may directly engaged the face perimeter portion or may be integrally formed with the face member; etc. Also, in this illustrated example face member structure 200, a hosel member 208 (for receiving shaft) 210 extends from the face member 200 (although other hosel constructions are possible without departing from this invention, including hosel-less and/or internal hosel structures).

The club head structure further includes a weight system provided along at least a portion of its rear periphery. In this illustrated example structure, the weight system includes a single weight element 220 that extends along and forms an exterior most surface of the club head structure. The weight element 220 may be made, in whole or in part, from any desired material, such as heavy metal or metal alloy materials (e.g., lead or tungsten, alloys of lead or tungsten, steel or other alloys with lead or tungsten contained therein and/or with lead or tungsten containing inserts, etc.), weight containing polymeric materials (e.g., lead or tungsten doped or containing plastics), etc. The weight element 220 also may include a conventional club head body member (e.g., made from conventional materials) with separate weight elements engaged therewith. In addition to extending along the rear periphery, this illustrated example weight element 220 also extends along the exterior toe and heel sides of the club head structure. If desired, rather than leaving a gap between its ends and the face member 200, the ends of the weight element 220 may extend up to and optionally engage the toe and heel edges of the face member 200 (e.g., engage the return portion 206, if any). While shown exterior in this example structure, if desired, in some example structures according to this invention, the weight system 220 may be located within an interior chamber defined by the overall club head body.

Weight systems in accordance with the invention may have other arrangements without departing from this invention. For example, if desired, the weight system may directly engage the damping member such that the weight system may be at least partially embedded in or contained by the damping member, such that the weight system may fit into a slot, groove, or chamber formed in the damping member, such that the weight system may extend at least partially around a periphery of the damping member (e.g., along the sides and/or rear periphery, etc.), etc. The weight system also may be located inside or outside the interior chamber defined by the club head body without departing from this invention.

FIG. 2A illustrates additional structures that may be included in golf club heads according to examples of this invention. For example, as shown in this figure, the rear surface of the club head face member 200 (and particularly, the rear surface of the ball striking face 202 in this example) is equipped with support structures 212*a* and 212*b*. These support structures 212*a* and 212*b* support the weight element 220 via a connection system. In this illustrated example, the connection system constitutes connection elements 222*a* and 222*b* that extend through the weight element 220 and toward the rear surface of the ball striking face 202. Connection elements 222*a* and 222*b* engage support structures 212*a* and 212*b*, respectively, to support the weight element 220 and engage it with the face member 200, as shown in FIG. 2B.

Any desired types of connection between the connection elements 222*a* and 222*b* with the support structures 212*a* and 212*b*, respectively, are possible without departing from this invention. For example, support structures 212*a* and 212*b* may include threads or other mechanical fastener element structures that engage with corresponding threads or other structures on connection elements 222*a* and 222*b*, respectively (the weight element 220 may include openings through which screws or bolts corresponding to connection elements 222*a* and 222*b* extend). As additional examples, if desired, the connection elements and support structures may be engaged via adhesives, cements, welding, soldering, brazing, or other fusing techniques.

While a variety of connection locations and arrangements are possible without departing from this invention, a direct connection between the weight element 220 and the ball striking face 202 is advantageous because this allows direct transfer of energy and momentum from the movement of the weight element 220 to the ball striking face 202. Moreover, the connection elements 222*a* and 222*b* support the ball striking face 202 and prevent excessive "trampoline" effect (and may allow for control of the club head's coefficient of restitution, if desired). The weight element 220 and the connection system may be constructed to be angled somewhat with respect to the horizontal direction (when the club head is in an address position) so that the weight element is positioned low and the overall center of gravity of the club head is located as far downward and rearward as possible (which features typically assist golfers in getting the ball airborne). Alternatively, if desired, the connection elements 222*a* and 222*b* may extend in a generally horizontal direction when the club head is at its ball address position.

The weight element 220 and the face member 200 of this illustrated example further include ledge elements 220*a* and 200*a*, respectively. The ledge elements 200*a* and 220*a* may be lowered somewhat with respect to the remainder of the member. In this illustrated example structure, ledge elements 200*a* and 220*a* provide a support area for receiving a crown member 230, as shown in FIG. 2B. While shown doing so, the ledge elements 200*a* and/or 220*a* need not completely extend along the entire periphery of the overall face member 200 and weight element 220. If desired, similar ledge structures may be provided for supporting the sole member. Any desired finishing procedures may be used to make the joint between the weight member 220, the crown portion 230, and the face member 200 smooth, including conventional securing and/or finishing techniques as are known and used in the art.

The crown member 230 may be made from any desired material without departing from this invention. Advantageously, in accordance with at least some examples of this invention, the crown member 230 will be constructed from a lightweight material, such as a lightweight metal material (e.g., aluminum, titanium, magnesium, or beryllium, and/or alloys including these metals), lightweight polymeric materials, carbon fiber composite materials, and/or other materials, including materials that are conventionally known and used in the art. The crown portion 230 may be fixed to the face member 200 and/or the weight element 220 in any desired manner without departing from this invention, including through the use of mechanical fasteners or connectors, adhesives, cements, welding, brazing, soldering, or other fusing techniques, etc.

Although not shown in FIGS. 2A and 2B, a sole plate member similar to crown portion 230 may be provided at the bottom surface of the overall club head structure. The sole plate member may be made from a heavier, denser material, such as a metal alloy material (e.g., steel, stainless steel, titanium alloys, etc.). This feature further helps maintain the center of gravity of the club head low. As another alternative, if desired, the crown portion 230 and the sole portion may be formed as a single part (and optionally may be attached to the face member 200 before the weight element 220 is attached), from the same material. In such structures, if desired, an additional sole plate (optionally of a denser metal alloy material) may be attached to the one piece crown portion/sole portion body member, e.g., to provide a lower center of gravity to the overall club head structure. The final assembled club head structure may appear like those illustrated in FIGS. 1A and 1B.

The weight element 220 need not be balanced and/or consistently sized and shaped throughout its peripheral length. Rather, if desired, the weight element 220 may be sized, shaped, and/or otherwise weighted so as to provide more weight toward the heel end or the toe end and/or toward the crown and/or sole portions of the overall club head structure. These features may be used to selectively place the weight at strategic locations in the club head structure, e.g., to affect ball flight or spin characteristics, to bias the club for specific types of ball flights (e.g., high flight bias, low flight bias, hook bias, draw bias, etc.), to control moment of inertia and/or center of gravity characteristics, and/or to help compensate for user's swing faults. As some more specific examples, selectively providing or concentrating weight in weight element 220 low (toward the sole) in a club head structure generally will help propel the ball on a higher trajectory and generally will help players get a ball airborne; selectively providing or concentrating weight in weight element 220 higher in a club head structure (e.g., more toward the crown) generally will help propel the ball lower, with a more boring flight path (which can help golf shots better cut through the wind); selectively providing or concentrating weight in weight element 220 outward in each direction away from the club head's front toward the rear will generally help increase the moment of inertia of the club head about the vertical axis at the club head's center of gravity (e.g., Izz) (which feature can help user's better propel the ball straight (e.g., this feature reduces club head twisting during off center (heel or toe) hits)); selectively providing or concentrating weight in weight element 220 toward the club head heel as opposed to its toe will help bias the club to propel the ball with more of a "draw" flight path (i.e., right-to-left for right handed players) and can help chronic slicers compensate for swing flaws (and thereby have a better chance of avoiding a slice); and selectively providing or concentrating weight in weight element 220 toward the club head toe as opposed to its heel will help bias the club to propel the ball with more of a "fade" flight path (i.e., left-to-right for right handed players) and can help chronic hookers compensate for swing flaws (and thereby have a better chance of avoiding a hook). Multiple weight elements 220 of the same size and shape (and/or portions of the overall weight element 220) may be made available (e.g., to users, club fitters, etc.) to allow users to quickly and easily customize and bias the club for specific ball flight characteristics (e.g., by removing connection elements 222*a* and 222*b* and exchanging one weight element 220 (or a portion thereof) for another with different characteristics).

Figure 3:
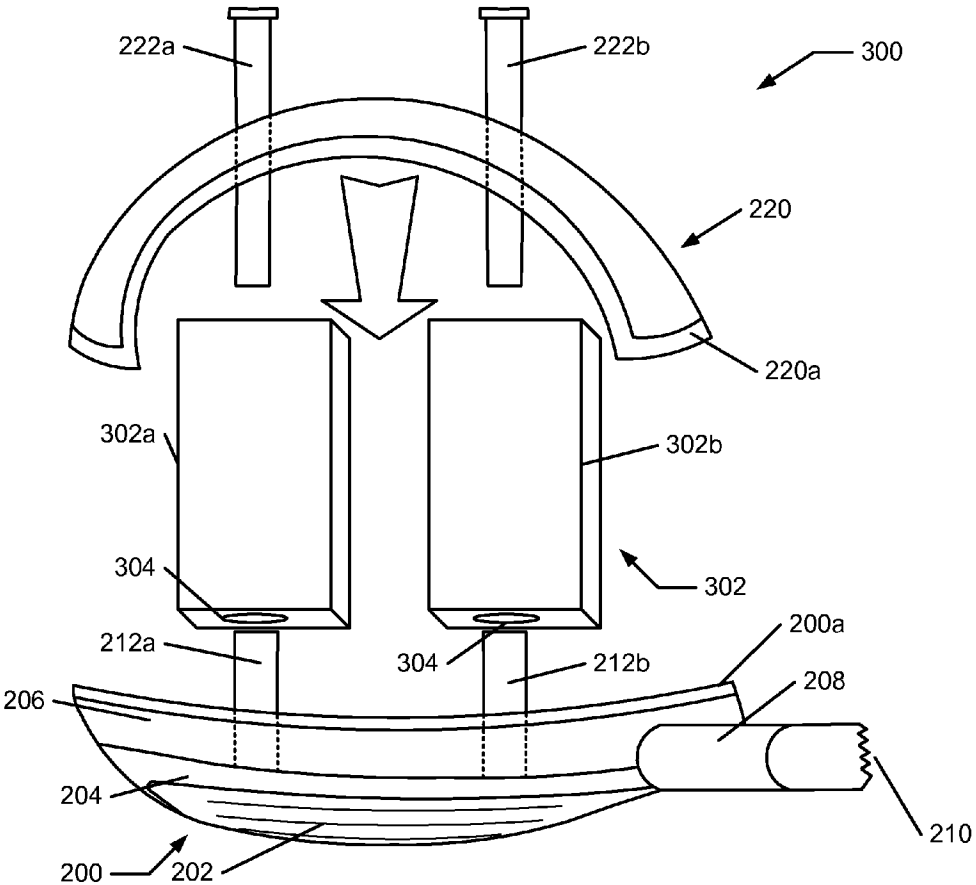
FIGS. 3 through 9 illustrate several variations on components and structures that may be provided in golf club head structures in accordance with this invention.

FIG. 3 illustrates additional features that may be available in golf club head structures in accordance with this invention. The assembly 300 of FIG. 3 is similar to that described above in conjunction with FIGS. 2A and 2B, except the club head assembly 300 of this example further includes a damping system 302 located within an interior chamber defined, at least in part, by the face member 200, the weight element 220, and/or the other parts of the club head body (not shown in FIG. 3). The damping system 302 can help attenuate the overall vibrational response of the club head experienced by a user when the club head is used to strike a golf ball. Moreover, the damping system can alter the sound that emanates from the club head during a ball strike. The assembly 300 of FIG. 3 may include various other club head body elements, such as one or more of a crown portion, a sole portion, an aft body element, or the like, without departing from this invention.

The damping system 302 may have a wide variety of characteristics without departing from this invention. In this illustrated example structure, the damping system 302 includes two separate damping elements 302*a* and 302*b* that fit around the support structures 212*a* and 212*b* and/or the connection elements 222*a* and 222*b* (support structures 212*a* and 212*b* and connection elements 222*a* and 222*b* fit through openings 304 provided in the damping elements 302*a* and 302*b*, in this example). Alternatively, if desired, damping system 302 may be flexible enough so as to simply fit or wrap around the support structures 212*a* and 212*b* and/or the connection elements 222*a* and 222*b*. While the damping system 302 may take up any desired portion of the volume of the interior chamber of the club head structure without departing from this invention (and may have any desired overall size(s) and/or shape(s)), in this illustrated example, the damping elements 302*a* and 302*b* extend all or substantially all of the distance between the weight element 220 and the rear surface of the ball striking plate member 202.

The damping elements 302*a* and 302*b* may be made from a variety of materials without departing from this invention. For example, if desired, the damping elements 302*a* and 302*b* may be made from lightweight polyurethane foam or other similar material. The damping elements 302*a* and 302*b* optionally may be compressed between the weight element 220 (or other portion of the club head body) and the face member 200 when the connection system 222*a* and 222*b* is engaged with the support structures 212*a* and 212*b*. As another example, if desired, the damping element may be injected into the interior chamber of the club head body after the club head is assembled (e.g., as a polymer foam or other material), e.g., through the club head's hosel opening or other opening. Other suitable materials for the damping system 302 include, but are not limited to, textiles, rubbers, ethylvinylacetates, fluid filled bladders (such as air bladders, etc.), and the like.

The club head face member, the body portions of the club head (e.g., the crown portion, the sole portion, intermediate body members (such as U-shaped bands or ribbons of material extending from the toe to the heel of the club and at least partially defining the sides and/or rear perimeter of the club head), etc.), the weighting system, and/or the connection system may have a wide variety of different sizes, shapes, constructions, and/or properties without departing from this invention. Various examples of these alternatives are illustrated in FIGS. 4 through 9. The reader should understand, however, that FIGS. 4 through 9 merely provide various examples of alternative structures and/or arrangements of parts in club head structures according to examples of this invention. These figures should not be construed as limiting the invention. Additionally, the reader should understand that the various structures and/or arrangements of parts shown in FIGS. 1A through 9 may be used in various different combinations and subcombinations without departing from this invention.

Other arrangements of parts are possible without departing from this invention. For example, if desired, the damping member(s) 302*a* and 302*b* may include threads or other structures that allow the weight member 220 and/or the connection elements 222*a* and 222*b* to be directly secured thereto without the need for the weight member 220 and/or the connection elements 222*a* and 222*b* to directly engage the face member 200. As another example, if desired, structures may be provided to allow the weight member 220 and/or the damping member(s) 302 to be engaged with a portion of the club head body other than (or in addition to) the face member 200, such as to the crown portion, the sole portion, the aft body portion, etc. Other constructions and/or arrangements of parts are possible without departing from this invention.

Figure 4:
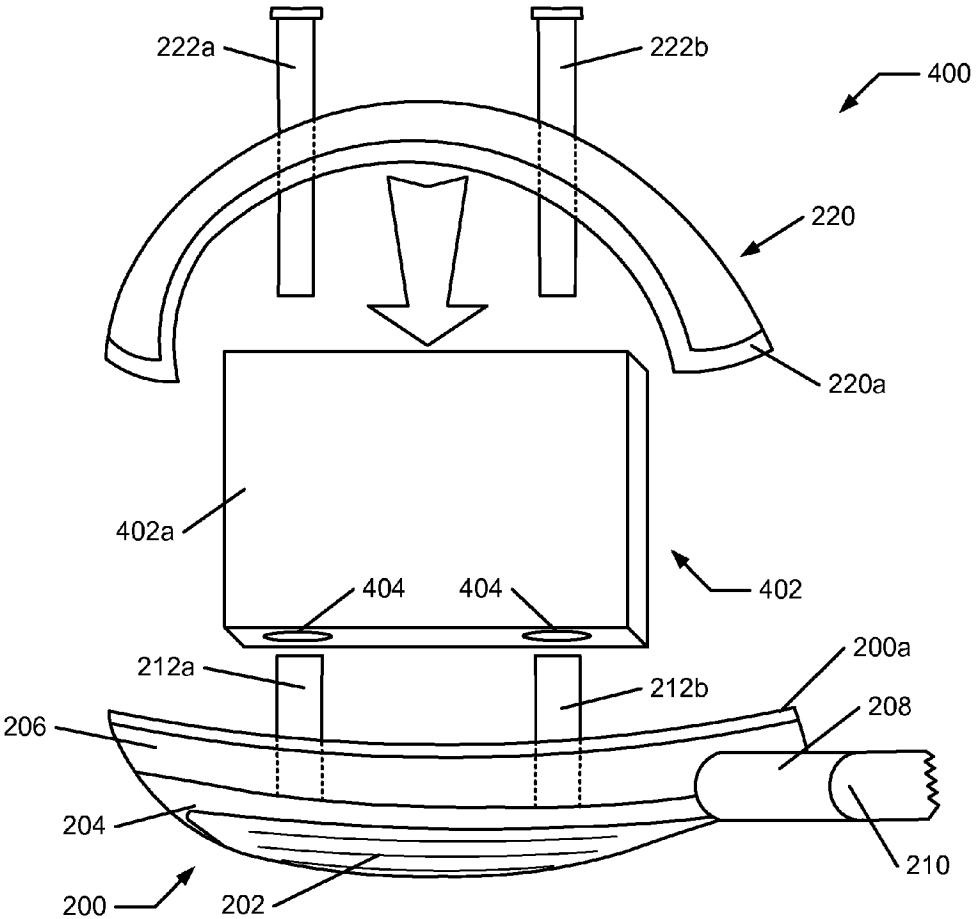

FIG. 4 illustrates a club head arrangement 400 similar to that shown in FIG. 3, except the damping system 402 differs from the damping system 302 of FIG. 3. More specifically, the damping system 402 of FIG. 4 is made up of a single damping element 402*a* into which the support structures 212*a* and 212*b* and/or the connection elements 222*a* and 222*b* extend. While the remainder of this illustrated club head arrangement 400 of FIG. 4 is the same as that shown for FIG. 3 (and may include any of the various options for the structure 300 described above with respect to FIG. 3), the reader should understand that the damping system arrangement of FIG. 4 may be applied to a wide variety of other club head constructions without departing from this invention.

Figure 5:
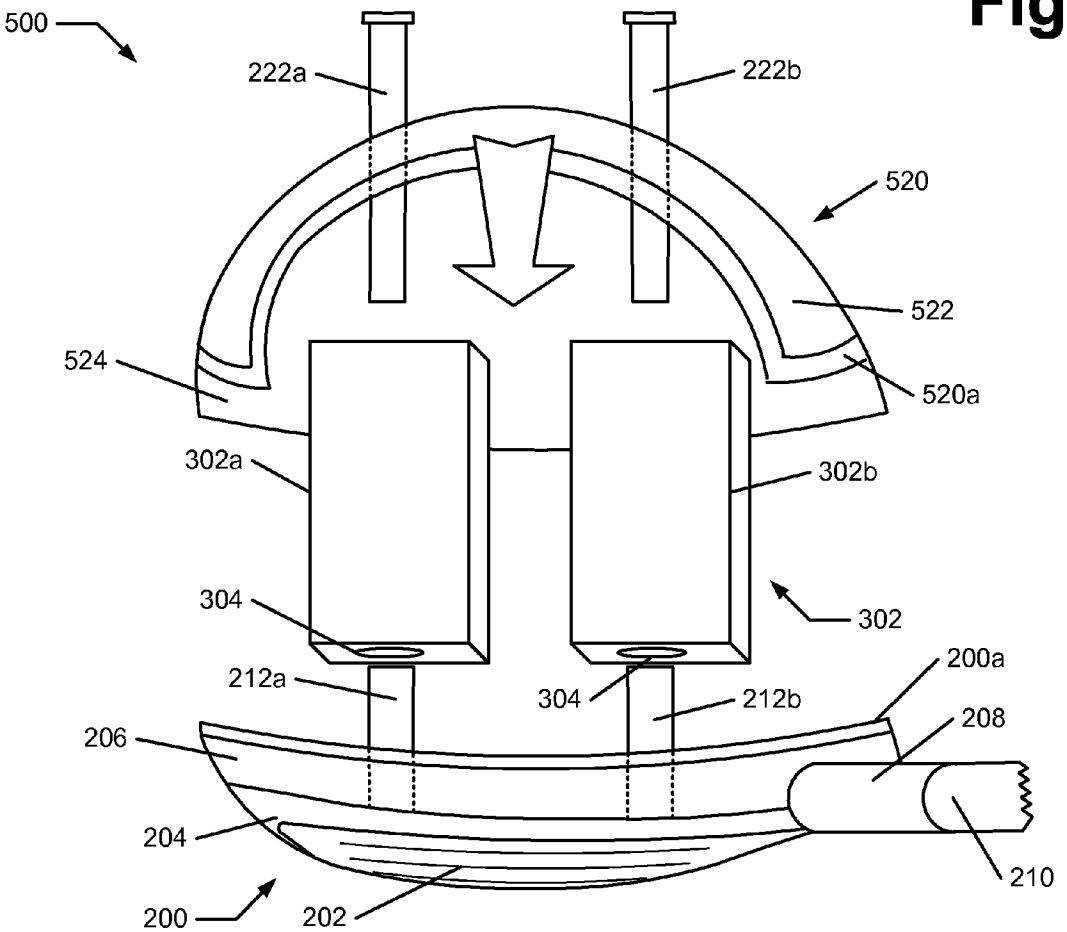

FIG. 5 illustrates another example club head structure 500 according to this invention. The example club head structure 500 illustrated in FIG. 5 is similar to that shown in FIG. 3, except, in this instance, the weight system 520 differs from that shown in FIG. 3. While weight system 520 still constitutes a single weight element 522 that extends around much of the toe, rear, and heel periphery of the club head structure and still includes a ledge 520*a* for engaging a separate crown member, this illustrated weight system 520 includes a sole member 524. The sole member 524 may be formed to attach to the return portion 206 of the face member 200 in this illustrated example. If desired, the sole member 524 also may extend upward to form at least some portions of the heel and/or toe sides or areas of the overall club head structure 500.

The sole member 524 may be included as part of the weight system 520 in any desired manner without departing from this invention. For example, the sole member 524 may be integrally formed as part of the weight element 522 as a unitary, one piece construction (e.g., during molding, casting, forging, or other production process for the weight system 520). As another example, if desired, the sole member 524 may be separately formed from the weight element 522 and then attached thereto at an appropriate time in the weight system and/or club construction process. The sole member 524 and weight element 522 may be engaged with one another in any desired manner without departing from this invention, including by mechanical fasteners or connectors, adhesives, cements, welding, soldering, brazing, other fusing techniques, or the like, including in conventional manners as are known and used in the art. Also, the sole member 524 may be made from the same or different materials from that of the weight element 522 without departing from this invention.

Figure 6:
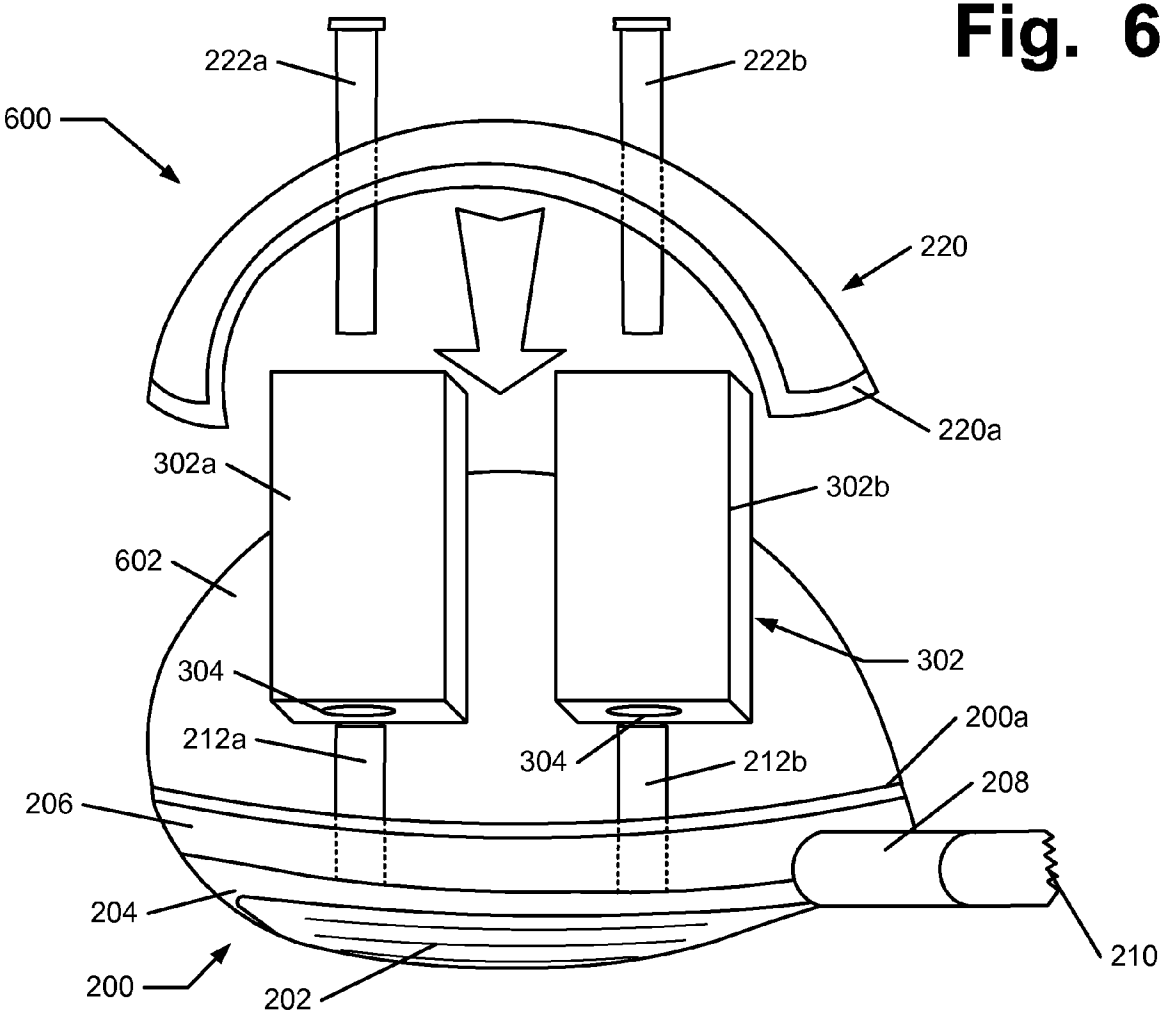

Another example club head structure 600 in accordance with this invention is illustrated in FIG. 6. The example structure 600 shown in FIG. 6 is similar to those shown in FIGS. 3 and 5, except with respect to the sole member. The sole member 602 of the structure 600 illustrated in FIG. 6 is formed as part of the face member 200. The sole member 602 may be formed to attach to the weighting system 220 in this illustrated example. If desired, the sole member 602 also may extend upward to form at least some portions of the heel and/or toe sides or areas of the overall club head structure 600.

The sole member 602 may be included as part of the face member 200 in any desired manner without departing from this invention. For example, the sole member 602 may be integrally formed as part of the face member 200 as a unitary, one piece construction (e.g., during molding, casting, forging, or other production process for the face member 200, such as an extension of the side and/or sole based return portion 206). As another example, if desired, the sole member 602 may be separately formed from the face member 200 and then attached thereto at an appropriate time in the face member 200 and/or overall club construction process. The sole member 602 and face member 200 may be engaged with one another in any desired manner without departing from this invention, including by mechanical fasteners or connectors, adhesives, cements, welding, soldering, brazing, other fusing techniques, or the like, including in conventional manners as are known and used in the art. Also, the sole member 602 may be made from the same or different materials from that of the face member 200 without departing from this invention.

Figure 7:
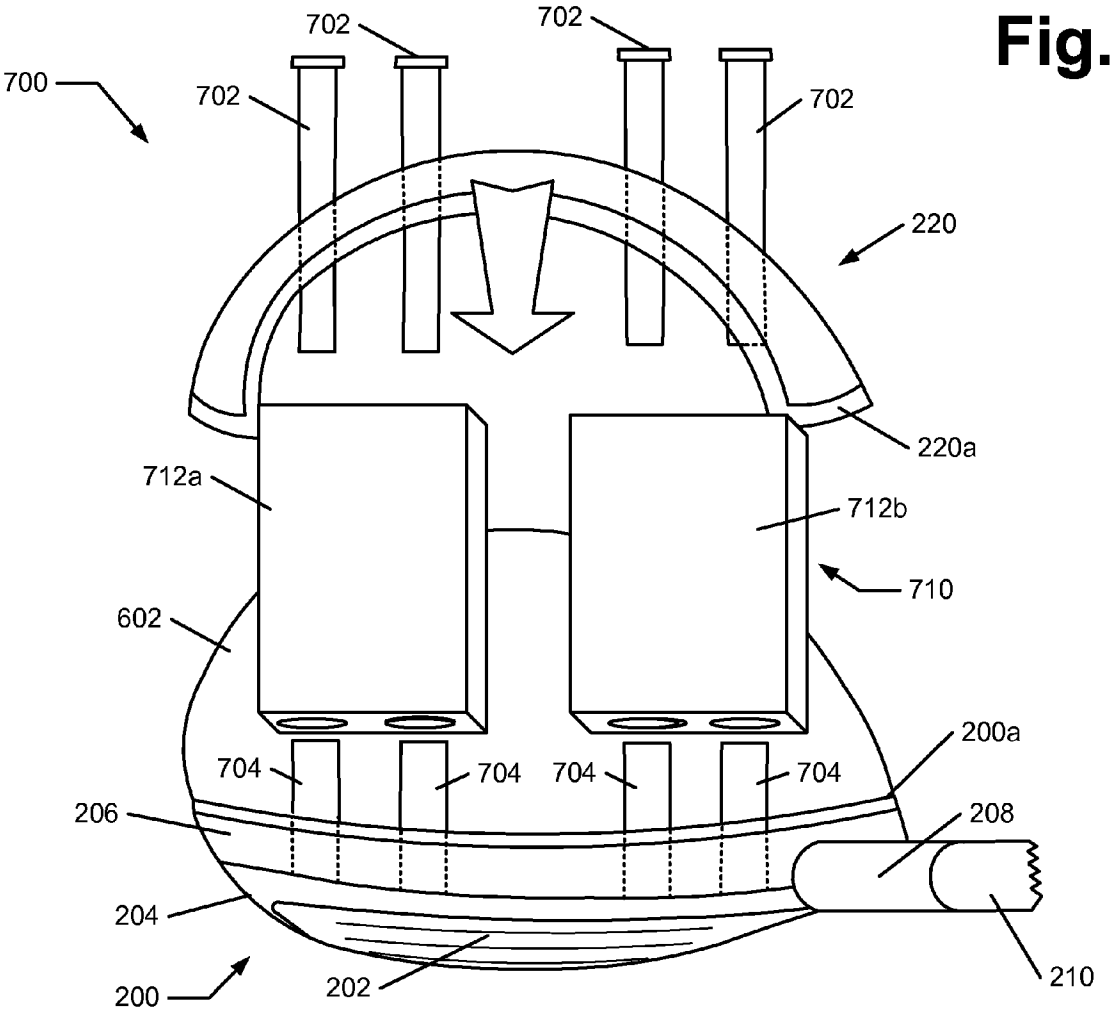

FIG. 7 illustrates another example golf club head structure 700 according to this invention. This example structure 700 is similar to that shown in FIG. 6, except the connection system differs. This illustrated example includes several connection elements 702 that extend through the interior chamber of the club head and engage corresponding support structures 704 provided on a rear surface of the ball striking face 202. Of course, any desired number of connection elements 702 and corresponding support structures 704 may be provided without departing from this invention. Additionally, the connection elements 702 may be arranged to extend in any desired direction(s) without departing from this invention and may be arranged at any desired positions with respect to the weight member 220 without departing from this invention (e.g., some connection elements 704 may engage the weight member 220 at a higher position than others, with respect to the club head body member oriented at its ball address position). If desired, the connection elements 702 may be made from different masses, e.g., to allow the user to "fine tune" the club head's weight distribution (e.g., to make the club head slightly heavier in the heel, toe, upper, and/or lower regions, to make the club head slightly heavier in the forward or rearward directions, etc.).

Also, in this illustrated example structure 700, the damping member 710 includes multiple independent damping elements 712*a* and 712*b*, each of which accommodates multiple connection elements 702 and multiple support elements 704. Of course, many variations in the damping member structure 710 and its relationship with the club head body, the connection system, and/or the weighting system are possible without departing from this invention, including, for example, one or more of the variations described above in conjunction with FIGS. 3 and 4.

Figure 8:
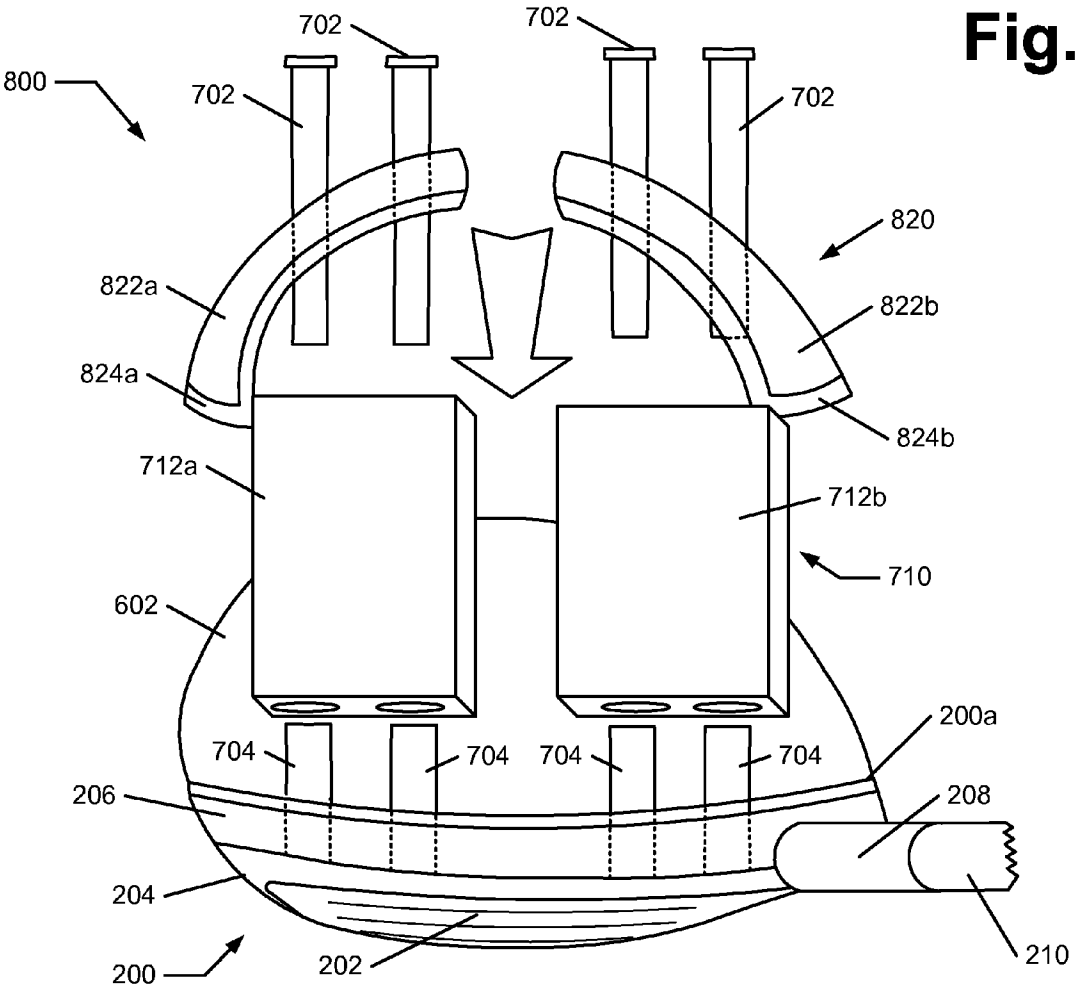

Another example club head structure 800 is illustrated in FIG. 8. The club head structure 800 of FIG. 8 is similar to that of FIG. 7, except the weight system 820 differs. In this example structure 800, the weight system 820 comprises multiple independent weight elements 822*a* and 822*b*. The independent weight elements 822*a* and 822*b* extend around at least a portion of the rear peripheral surface (exterior surface in this example structure 800) of the club head structure 800. If desired, the weight elements 822*a* and 822*b* may contact one another at the center back location, or they may be separated from one another by a space and/or by a structural element of the club head body. Likewise, the opposite (front) ends of weight elements 822*a* and 822*b* may contact and/or connect to the face member 200, or they may remain separated therefrom by a space and/or by a structural element of the club head body. The weight elements 822*a* and 822*b* may include a ledge element 824*a* and 824*b*, respectively, for engaging a crown portion, a sole portion, or other portion of the club head body member.

The weight elements 822*a* and 822*b* may be the same, mirror images, or different from one another without departing from this invention. In some example structures, the heel weight element 822*b* may be different from the toe weight element 822*a*, e.g., in size, weight, structure, etc., to allow the club head to be biased for specific ball flight conditions, as described above.

Figure 9:
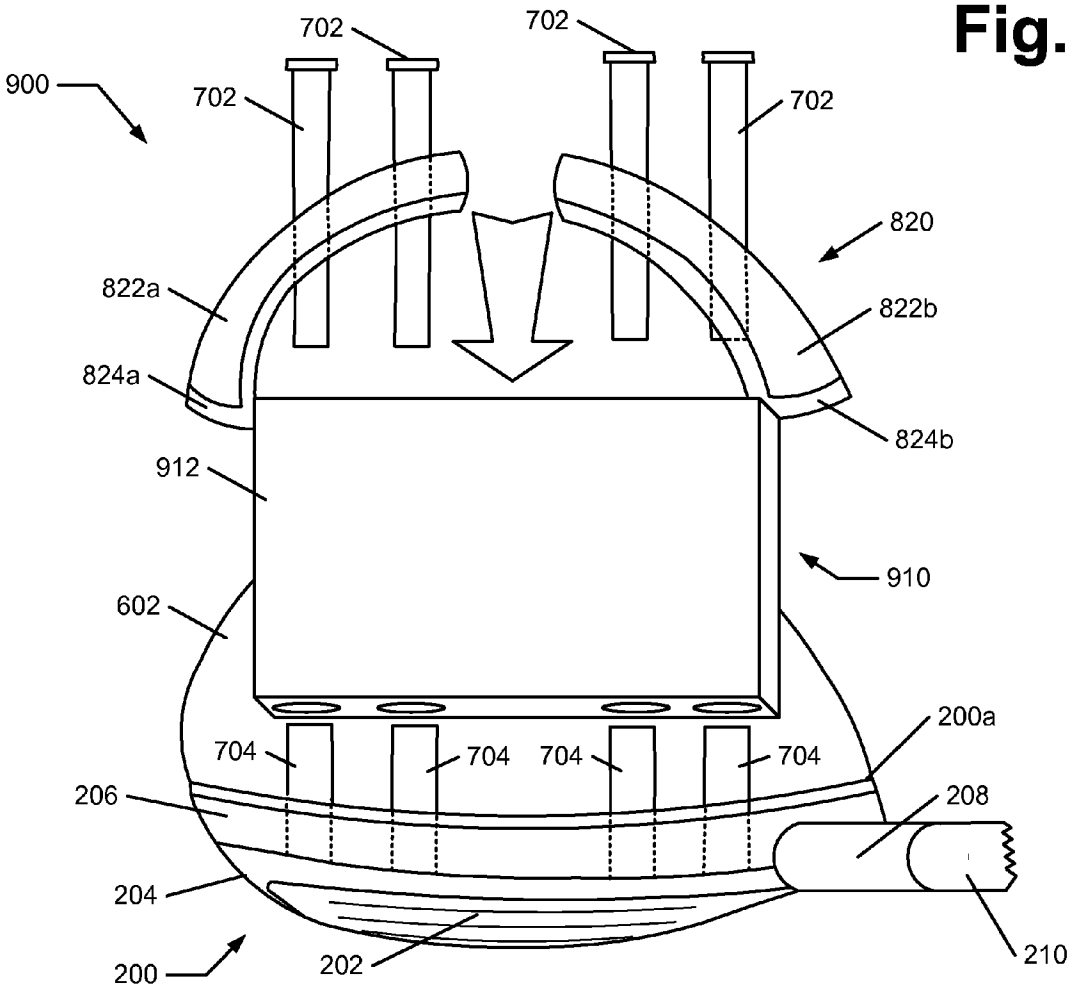

FIG. 9 illustrates a club head structure 900 similar to that of FIG. 8, but in this structure the damping system 910 constitutes a single damping element 912, as opposed to the multipart damping system 710 shown in FIG. 8. This single damping element 912 may be compressed within an interior chamber defined by the club head body, between the rear surface of the ball striking face 202 and the rear portion of the club head body and/or the weight elements 822*a* and 822*b*. This single damping element 912 also engages all of the connection system elements 702 and the corresponding support elements 704. Of course, any desired arrangement of connection system elements and support elements may be provided without departing from this invention. Also, if desired, the damping system may be injected into the interior of the club head body (e.g., through the hosel opening 208 or another opening) after the club head body is assembled.

If desired, one or more weight elements making up a portion of the weighting system in various example structure according to this invention may be mounted in weight ports provided in or on an exterior surface of the golf club head body member, optionally in a removable manner (e.g., using threaded connection elements that engage threaded support elements provided at or near the rear face of the ball striking face). In this manner, users, club fitters, or the like can freely select the weights (optionally of different masses) to place at desired locations on the club head to better fit the club head's weighting characteristics to the user's swing and/or desired ball flight characteristics). Other weighting techniques (e.g., permanently mounted weight elements, movable weight elements, and/or removable weight elements) may be used, individually or in combination, without departing from this invention, including conventional weighting techniques and structures as are known and used in the art. If desired, the connection elements (e.g., 222*a*, 222*b*, and 702) may serve as at least a portion of the weighting system.

Features of this invention may be used for producing a wide variety of wood-type golf club head structures. While wood type hybrid club structures generally have been described above in detail and illustrated in the attached drawings, other types of club head structures that may be produced in accordance with at least some examples of this invention include: drivers, fairway woods (e.g., 2 through 13 woods), putters, chipping type clubs, and the like.

The driver or other club heads may have any size and/or dimensional characteristics without departing from this invention, including conventional size and/or dimensional characteristics for wood-type and other golf clubs and golf club heads as are known and used in the art. When used to make driver or other wood type golf club structures, golf club heads in accordance with at least some examples of this invention may have an overall club head breadth B dimension (maximum front face to rear dimension) of at least 4.2 inches, at least 4.4 inches, at least 4.5 inches, at least 4.6 inches, or even or at least 4.8 inches. Club head body structures in accordance with this invention further may have an overall club head length dimension L (maximum heel to toe dimension) of at least 4.5 inches, at least 4.7 inches, or even at least 4.8 inches. The club head shape and/or structure may be controlled such that the overall club head body size is 500 $cm^3$ or less, 470 $cm^3$ or less, or even 460 $cm^3$ or less. In at least some examples, the overall club head body size or volume will be at least 350 cc, at least 400 cc, at least 420 cc, or even at least 450 cc. Loft angles for drivers may range, for example, from 6.5° to 16.0°. Such clubs may have a conventional "pear-like" overall shape, a more modern "square" or "rectangular" shape, or any other desired shape.

When used in producing hybrid type golf clubs, the clubs also may have any desired sizes and/or dimensional characteristics, including conventional size and/or dimensional characteristics as are known and used in the art. Typical loft angles for hybrid type clubs in accordance with at least some examples of this invention will range from 15° to 30°; typical lie angles will range from 55° to 65°; and typical overall club lengths will range from 36 to 42 inches, although other dimensions are possible without departing from this invention. Such clubs may have a conventional "pear-like" overall shape, a more modern "square" or "rectangular" shape, or any other desired shape.

Many modifications to the overall club head structures and/or the overall golf club structures may be made without departing from this invention. For example, many modifications may be made to the part or parts making up the club head structure, to the materials used in making the club head structure, to the manner in which the club head structure is joined together, etc. Also, many modifications may be made to the thickness, weight, shape, size, and/or other physical characteristics of the part or parts making up the overall golf club structure, etc.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head, comprising:

a club head body member, the club head body member including a ball striking face portion, a crown portion, and a sole portion;

a weight system engaged with the club head body member and provided at and extending along a perimeter portion of the club head body member at a location rearward of the ball striking face portion, wherein the weight system forms an exterior-most surface of the club head body member, wherein the weight system is sized, shaped, and/or weighted to selectively provide weight at various locations in the club head body member;

a damping member at least partially located between the ball striking face portion and the weight system; and a connection system extending through the weight system in a direction toward the ball striking face portion of the club head body member, wherein the connection system includes a first connection element engaging the weight system with the ball striking face portion and a second connection element engaging the weight system with the ball striking face portion.

2. A golf club head according to claim 1, wherein the damping member extends between the ball striking face portion and the weight system.

3. A golf club head according to claim 1, wherein the damping member is made of a polyurethane material.

4. A golf club head according to claim 1, wherein the connection system extends at least partially through the damping member.

5. A golf club head according to claim 1, wherein the damping member is engaged with the connection system.

6. A golf club head according to claim 1, wherein the damping member attenuates at least some vibration resulting from contact between a golf ball and the ball striking face portion.

7. A golf club head according to claim 1, wherein the weight system includes a first weight element and a second weight element separate from the first weight element.

8. A golf club head according to claim 7, wherein the connection system includes a first connection element engaging the first weight element with the ball striking face portion and a second connection element engaging the second weight element with the ball striking face portion.

9. A golf club head, comprising:

a face member including a ball striking face, wherein an interior portion of the face member includes at least a portion of a fastener system;

a body member engaged with the face member, wherein the body member includes at least a crown portion;

a weight system provided and extending along at least some part of a rear perimeter portion of the golf club head, wherein the weight system forms an exterior most surface on the golf club head, wherein the weight system is sized, shaped, and/or weighted to selectively provide weight at various locations in the golf club head; and a connection system extending from or through the weight system to the face member, the connection system engaging the fastener system, wherein the golf club head further includes a damping element provided at least partially between the face member and the weight system.

10. A golf club head according to claim 9, wherein the damping element engages at least one of the connection system or the fastener system.

11. A golf club head according to claim 9, wherein the damping element extends between the face member and the weight system.

12. A golf club head, comprising:

a face member including a ball striking face, wherein an interior portion of the face member includes at least a portion of a fastener system;

a body member engaged with the face member, wherein the body member includes at least a crown portion, and further wherein the face member and the body member define an interior chamber that is at least partially hollow after the club head is assembled;

a weight system provided and extending along at least some part of a rear perimeter portion of the golf club head, wherein the weight system forms an exterior most surface on the golf club head, wherein the weight system is sized, shaped, and/or weighted to selectively provide weight at various locations in the golf club head;

a damping element provided between the face member and the weight system; and a connection system extending through the weight system to the face member, the connection system engaging the fastener system.

13. A golf club head according to claim 12, wherein the fastener system includes a first fastener element and a second fastener element, and wherein the connection system includes a first connection element engaging the first fastener element and a second connection element engaging the second fastener element.

14. A golf club head according to claim 13, wherein the damping element engages at least one of the connection system or the fastener system.

15. A golf club head according to claim 13, wherein the damping member extends between the face member and the weight system.

* * * * *